US010774566B2

(12) United States Patent
Long et al.

(10) Patent No.: US 10,774,566 B2
(45) Date of Patent: Sep. 15, 2020

(54) FINGERPRINT PADLOCK

(71) Applicant: PURIMEE QIANHAI (SHENZHEN) INTELLIGENT TECHNOLOGY CO., LTD., Shenzhen (CN)

(72) Inventors: Licai Long, Shenzhen (CN); Hai Li, Shenzhen (CN); Zhihong Luo, Shenzhen (CN)

(73) Assignee: Purimee Qianhai (Shenzhen) Intelligent Technology Co., Ltd., Shenzhen (CN)

( * ) Notice: Subject to any disclaimer, the term of this patent is extended or adjusted under 35 U.S.C. 154(b) by 184 days.

(21) Appl. No.: 16/181,900

(22) Filed: Nov. 6, 2018

(65) Prior Publication Data

US 2019/0226241 A1 Jul. 25, 2019

(51) Int. Cl.

| | |
|---|---|
| ***E05B 67/00*** | (2006.01) |
| ***E05B 15/04*** | (2006.01) |
| ***E05B 47/06*** | (2006.01) |
| ***E05B 35/00*** | (2006.01) |
| ***G07C 9/00*** | (2020.01) |
| ***E05B 47/00*** | (2006.01) |
| ***E05B 67/22*** | (2006.01) |

(52) U.S. Cl.

CPC ..... *E05B 67/003* (2013.01); *E05B 15/04* (2013.01); *E05B 47/0012* (2013.01); *E05B 47/0603* (2013.01); *E05B 67/22* (2013.01); *G07C 9/00563* (2013.01); *E05B 2035/009* (2013.01)

(58) Field of Classification Search

CPC ..... E05B 67/003; E05B 15/04; E05B 67/22; E05B 47/0603; E05B 47/0012; E05B 2035/009; E05B 67/006; E05B 2015/0413; G07C 9/00563

USPC ... 70/14, 18, 30, 49, 53, 58, 38 C, 233, 277, 70/278.1, 278.7, 279.1, 280–282

See application file for complete search history.

(56) References Cited

U.S. PATENT DOCUMENTS

| | | | |
|---|---|---|---|
| 6,675,673 | B2 | 1/2004 | Starken |
| 7,051,561 | B2 | 5/2006 | Moon et al. |
| 8,302,438 | B2 | 11/2012 | Lui |
| 8,353,187 | B2 | 1/2013 | Woodling |
| 8,671,723 | B2 | 3/2014 | Dayanikli et al. |
| 8,800,402 | B2 | 8/2014 | Weum |
| 8,850,858 | B2 | 10/2014 | Nave |
| 9,850,685 | B2 | 12/2017 | Dore Vasudevan et al. |
| 9,982,462 | B2 | 5/2018 | Lin et al. |
| 10,400,481 | B2 * | 9/2019 | Wong ..... E05B 47/00 |
| 10,422,163 | B1 * | 9/2019 | Cabral Herrera .. G07C 9/00563 |

(Continued)

*Primary Examiner* — Lloyd A Gall

(74) *Attorney, Agent, or Firm* — Miles & Stockbridge P.C.

(57) ABSTRACT

A fingerprint padlock comprises a lock case, a lock rope, a locking unit, a lock detecting unit, and a fingerprint unit. The locking unit, a lock detecting unit, and a fingerprint unit are enclosed in the lock case. A lock hole is provided in the lock case. The lock rope comprises a fixed end that is fixed in the lock case and a movable end configured to be inserted into the lock hole. The locking unit is configured to lock and unlock the movable end, and the lock detecting unit is configured to detect whether the movable end is inserted into the lock hole. The fingerprint unit is configured to detect whether the fingerprint of a user is matched and send an unlocking instruction to the locking unit when the fingerprint of the user is matched. The fingerprint padlock is convenient to carry and use.

5 Claims, 4 Drawing Sheets

(56) References Cited

U.S. PATENT DOCUMENTS

| | | | | |
|---|---|---|---|---|
| 10,428,557 | B2 * | 10/2019 | Niroomand | E05B 67/36 |
| 10,458,153 | B2 * | 10/2019 | Nguyen | G07C 9/00944 |
| 2006/0075793 | A1 * | 4/2006 | Yu | E05B 37/025 70/30 |
| 2007/0126551 | A1 * | 6/2007 | Slevin | E05B 67/00 340/5.53 |
| 2010/0083713 | A1 * | 4/2010 | Woodling | E05B 47/0603 70/22 |
| 2011/0041570 | A1 * | 2/2011 | Huang | E05B 37/0034 70/21 |
| 2013/0055773 | A1 * | 3/2013 | Li | G07C 9/0069 70/278.1 |
| 2015/0204110 | A1 | 7/2015 | Boutelegier | |
| 2017/0009491 | A1 * | 1/2017 | Nguyen | G07C 9/00944 |
| 2018/0051483 | A1 * | 2/2018 | Yuan | E05B 47/0603 |
| 2018/0075679 | A1 * | 3/2018 | Niroomand | E05B 47/026 |
| 2018/0119452 | A1 | 5/2018 | Dore Vasudevan et al. | |
| 2018/0209174 | A1 * | 7/2018 | Ho | E05B 47/0603 |
| 2019/0156607 | A1 * | 5/2019 | Tao | G07C 9/00563 |
| 2019/0226242 | A1 * | 7/2019 | Long | E05B 15/04 |
| 2019/0344849 | A1 * | 11/2019 | Weiershausen | E05B 47/0012 |
| 2019/0383057 | A1 * | 12/2019 | Larson | E05B 67/063 |

* cited by examiner

FINGERPRINT PADLOCK

CROSS-REFERENCE TO RELATED APPLICATIONS

This application claims the benefit of priority to Chinese Patent Application No. 201820141781.X entitled "A Type of Padlock," filed on Jan. 23, 2018, Chinese Patent Application No. 201810818922.1 entitled "A Fingerprint Padlock," filed on Jul. 24, 2018, and Chinese Patent Application No. 201821176170.5 entitled "A Fingerprint Padlock," filed on Jul. 24, 2018. The entire contents and disclosures of these patent applications are incorporated herein by reference.

BACKGROUND

Field of the Invention

The embodiments of the present invention generally relates to the field of locks, and more particularly, to a fingerprint padlock.

Background Art

A padlock is a common type of lock. The traditional padlock usually comprises a lock body, a lock cylinder, a lock lever, a key, and other components. The padlock is closed and opened by using the key. The traditional padlock has the following defects: 1. the key and the lock body are inconvenient to be carried; 2. the lock can be opened with a key by anyone, and the key itself is easy to be copied, and therefore there are inherent security risks.

With the development of science and technology, new types of locks such as password locks, magnetic card locks, and fingerprint locks have appeared on the market. The password lock heavily relies on people's memory of passwords. In reality, there are so many kinds of passwords and people are easy to forget them and make mistakes. A magnetic card lock itself does not overcome the drawbacks of the traditional locks, such as being inconvenient to carry and easy to copy. Currently, common fingerprint locks are complicated in structure, large in size, bulky in lock body, inconvenient to carry, limited in use place, and the like. In addition, a traditional fingerprint lock has short unlocking and locking process time, and people cannot turn off the motor in time. The motor continues to run even after the unlocking or locking process has completed. As a result, a pushing pressure is generated on the internal structure of the lock cylinder, which easily causes damage to the internal structure of the lock cylinder, resulting in a high failure rate.

SUMMARY

According to first broad aspect, the present invention provides a fingerprint padlock comprising a lock case provided with a lock hole, a lock rope, a locking unit, a lock detecting unit, and a fingerprint unit. The locking unit, the lock detecting unit, and the fingerprint unit are enclosed in the lock case. The lock rope comprises a fixed end and a movable end, the fixed end being fixed in the lock case, and the movable end being configured for being inserted into the lock hole. The lock detecting unit is configured to detect whether the movable end is inserted into the lock hole or not. The fingerprint unit is configured to detect whether the fingerprint of a user is matched or not, and to send an unlocking instruction to the locking unit when the fingerprint of the user is matched. The locking unit is configured to lock and unlock the movable end. The locking unit comprises a locking fixing member; a tumbler; a motor having a motor shaft; a bolt comprising a guiding portion, a locking portion, and a limiting portion formed by hollowing out from the locking portion; a bolt spring; a driving cap having a lug boss; and a tumbler spring sleeved on the driving cap. The bolt spring is mounted on the guiding portion of the bolt. A gap for the movable end of the lock rope to insert is formed between the bolt and the locking fixing member. The driving cap is fixedly mounted on the motor shaft of the motor. The lug boss is able to rotate in a threaded gap of the tumbler spring to drive the tumbler spring to move when the driving cap rotates. A vertical groove is formed in the tumbler. An upper and a lower terminals of the tumbler spring are clamped into the vertical groove and being able to slide up and down in the vertical groove.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

Figure 1:
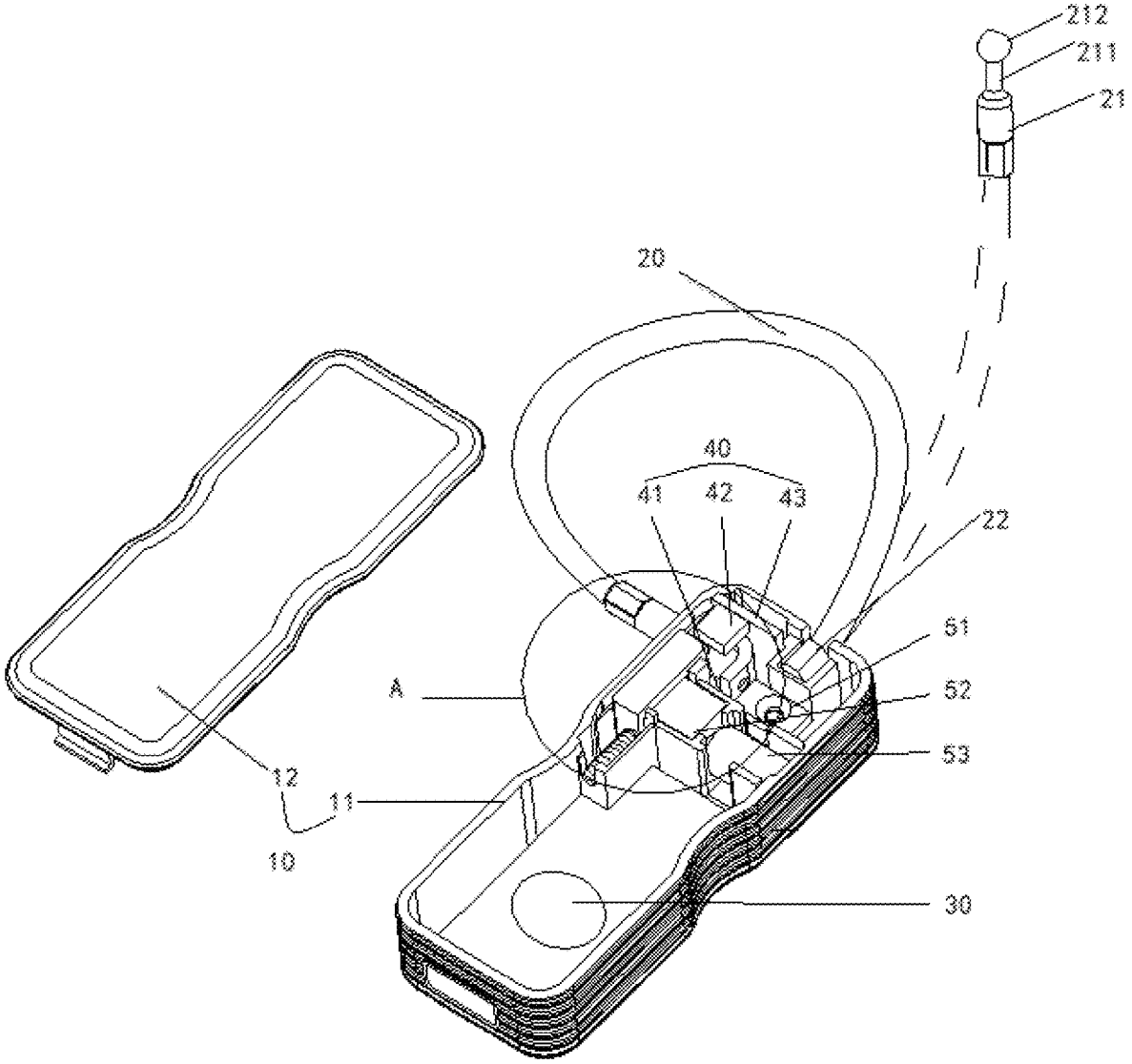
FIG. 1 is a schematic structural diagram of an exemplary fingerprint padlock according to an embodiment of the present invention.

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternatives falling within the spirit and the scope of the invention.

An object of the present invention is to provide a fingerprint padlock that is convenient to carry and use, and less susceptible to damage.

The technical solution adopted by embodiments of the present invention to solve the technical problems thereof is as follows:

A fingerprint padlock comprises a lock case, a lock rope, a locking unit, a lock detecting unit, and a fingerprint unit, wherein the locking unit, the lock detecting unit, and the fingerprint unit are enclosed in the lock case;

the lock rope comprises a fixed end and a movable end, the lock case is provided with a lock hole, the fixed end is fixed in the lock case, and the movable end is used for being inserted into the lock hole;

the lock detecting unit is configured to detect whether the movable end is inserted or not;

the fingerprint unit is configured to detect whether a fingerprint of a user is matched or not, and sending an unlocking instruction to the locking unit when the fingerprint of the user is matched;

the locking unit is configured to lock and unlock the movable end, and the locking unit comprises a locking fixing member, a tumbler, a motor, a bolt, a bolt spring, a driving cap, and a tumbler spring; the bolt comprises a guiding portion, a locking portion and a limiting portion formed by hollowing out from the locking portion; the bolt spring is arranged on the guiding portion of the bolt; a gap for the movable end of the lock rope to insert is formed between the bolt and the locking fixing member, and the driving cap is fixedly mounted on a motor shaft of the motor; the tumbler spring is sleeved on the driving cap, and a lug boss is arranged on the driving cap; when the driving cap rotates, the lug boss can rotate in a threaded gap of the tumbler spring, thereby driving the tumbler spring to move; the tumbler is sleeved on the driving cap; a vertical groove is provided in the tumbler, and an upper and a lower terminals of the tumbler spring are clamped into the vertical groove and can slide up and down in the vertical groove.

Further, the lock detecting unit comprises an infrared emitting tube, an infrared receiving tube, and a detection PCB sensor ("PCB") connected with the infrared emitting tube and the infrared receiving tube. The infrared emitting tube, the infrared receiving tube, and the detection PCB sensor are relatively positioned.

Further, the lock case comprises a surface shell and a bottom shell configured to interlock with each other.

Further, the tumbler, the motor, the tumbler spring and the driving cap are assembled into a whole, and embedded in the bottom of the inside of the surface shell; when the movable end of the lock rope is inserted into the gap between the bolt and the locking fixing member, the motor rotates to allow the tumbler to move radially and to be inserted into the limiting portion of the bolt, thereby immobilizing the bolt. At this time, the movable end of the lock rope is immobilized by the bolt and the locking fixing member.

Further, the movable end of the lock rope comprises a cylindrical neck and a spherical head, and the diameter of the head is greater than the diameter of the neck.

Compared with the prior art, the fingerprint padlock provided by the embodiments of the present invention adopts a lock rope as a locking component, the length of the lock rope being able to be freely selected, and the lock rope is flexible and can be bended and curled. Therefore, the fingerprint padlock described herein has great convenience and practicability to use. The fingerprint padlock is particularly suitable for the locking requirements of different kinds of guns. In addition, due to the structure of the locking unit, when the tumbler runs to a limit position, even if the motor is still rotating, the tumbler will not continue to move up or down, and will not generate a push-up pressure on the internal structure of the padlock. Thus, the fingerprint padlock disclosed herein does not have a "dead point," and its internal structures are not easy to be damaged.

The present invention will be further described in detail below with reference to the accompanying drawings and embodiments in order to make the objects, technical solutions and advantages of the present invention clearer. It is understood that the preferred embodiments described herein are merely illustrative of the present invention and are not intended to limit the present invention.

As shown in FIG. 1, an embodiment of the present invention provides a fingerprint padlock, which comprises a lock case 10, a lock rope 20, a fingerprint unit 30, a lock detecting unit 40, and a locking unit 50. The lock case 10 comprises a surface shell 11 and a bottom shell 12 assembled with the surface shell 11. The lock rope 20 comprises a movable end 21 and a fixed end 22, and the fixed end 22 is fixed in the lock case 10 when the surface shell 11 interlocks with the bottom shell 12. A lock hole (not shown in figure) is also provided in the lock case 10, and the movable end 21 of the lock rope 20 is inserted into the lock hole to perform locking.

It should be noted that FIG. 1 illustrates the two states in which the movable end 21 of the lock rope 20 is inserted into the lock hole and is pulled out of the lock hole. The movable end 21 of the lock rope 20 comprises a cylindrical neck 211 and a spherical head 212, and the diameter of the head 212 is greater than the diameter of the neck 211 so that the head 212 can be locked by the locking unit 50 when the movable end 21 of the lock rope 20 is inserted into the lock hole.

The fingerprint unit 30 is disposed at the bottom of the inside of the surface shell 11 and is used for detecting whether a fingerprint of a user is matched or not. When the fingerprint of the user is matched, the fingerprint unit 30 sends an unlocking instruction to the locking unit 50.

The lock detecting unit 40 is disposed in the surface shell 11 and comprises an infrared emitting tube 41, an infrared receiving tube 42, and a detecting PCB 43 connected with the infrared emitting tube 41 and the infrared receiving tube 42. The infrared emitting tube 41, the infrared receiving tube 42, and the detecting PCB 43 are relatively positioned. When locking is performed, the movable end 21 of the lock rope 20 is inserted into the lock hole, the infrared light emitted by the infrared emitting tube 41 is blocked by the movable end 21 of the lock rope 20, and the infrared receiving tube 42 cannot receive an optical signal, thereby detecting the state of the lock. The detecting PCB 43 is used for controlling the infrared emitting tube 41 to emit infrared light and detecting the state of the infrared receiving tube 42, thereby judging the state of the lock. When the movable end 21 of the lock rope 20 blocks the infrared light, and the infrared receiving tube 42 cannot receive the infrared light signal, a locking signal is recognized, and the lock detecting unit 40 instructs the locking unit 50 to perform the locking action.

Figure 2:
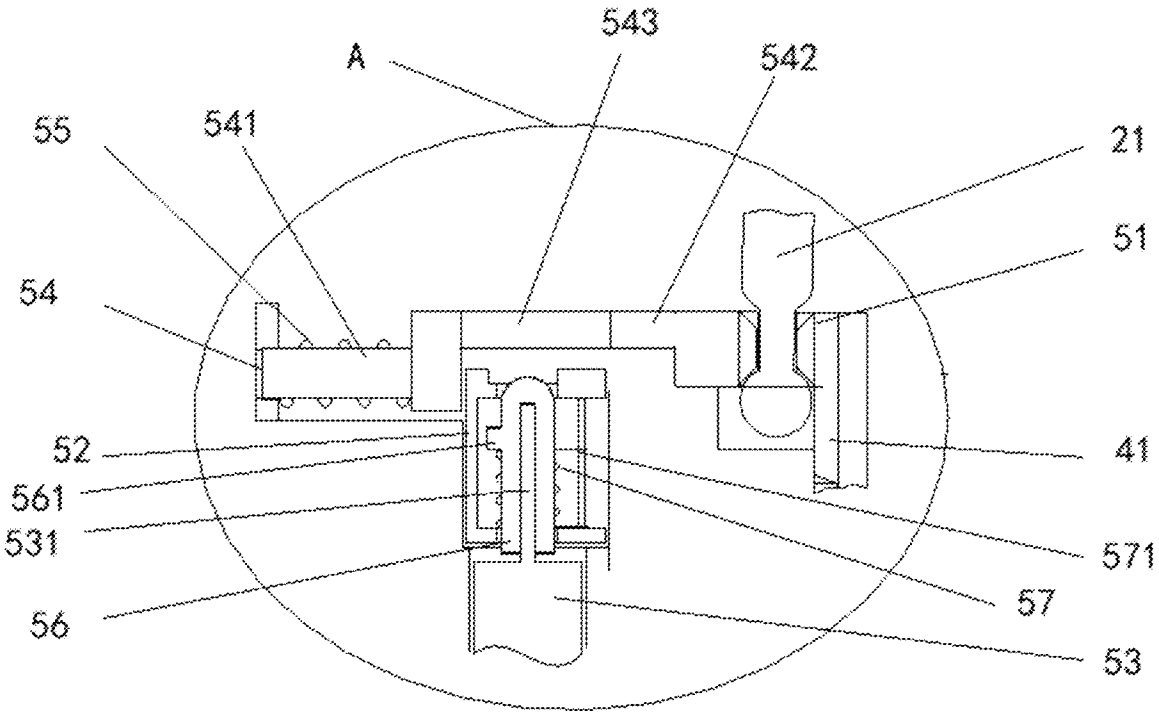
FIG. 2 is a schematic structural diagram of portion A in FIG. 1.

As shown in FIG. 2, the locking unit 50 comprises a locking fixing member 51, a tumbler 52, a motor 53, a bolt 54, a bolt spring 55, a driving cap 56 and a tumbler spring 57. The locking fixing member 51 is fixedly arranged at the bottom of the surface shell 11 through screws. The bolt 54 comprises a guiding portion 541, a locking portion 542 and a limiting portion 543 formed by hollowing out from the locking portion 542. The bolt spring 55 is arranged on the guiding portion 541 of the bolt 54. The driving cap 56 is fixedly mounted on a motor shaft 531 of the motor 53, the tumbler spring 57 is sleeved on the driving cap 56, and a lug boss 561 is arranged on the driving cap 56; the lug boss 561 can rotate in the threaded gap of the tumbler spring 57 with the rotation of the driving cap 56 to drive the tumbler spring 57 to move, and the tumbler 52 is sleeved on the driving cap 56; a vertical groove 571 is formed in the tumbler 52, and upper and lower terminals of the tumbler spring 57 are clamped into the vertical groove 571 and can slide up and down in the vertical groove 571.

The tumbler 52, the motor 53, the tumbler spring 57 and the driving cap 56 are assembled into a whole and embedded in the bottom of the inside of the surface shell 11; when the movable end 21 of the lock rope 20 is inserted into the gap between the bolt 54 and the locking fixing member 51, the motor 53 rotates to cause the tumbler 52 to move radially and to be inserted into the limiting portion 543 of the bolt 54, thereby fixing the bolt 54, at which time the movable end 21 of the lock rope 20 is fixed by the bolt 54 and the locking fixing member 51.

Figure 3:
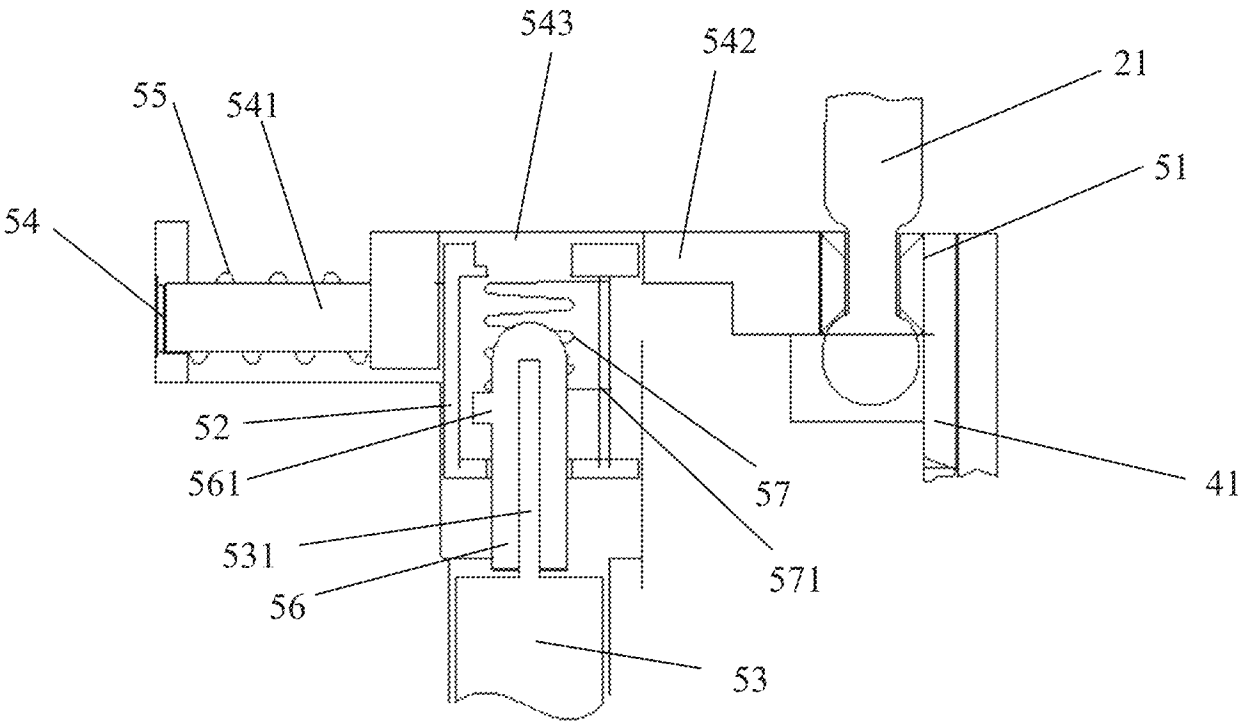
FIG. 3 is a schematic structural diagram of an exemplary fingerprint padlock when being locked according to an embodiment of the present invention.

The working principle of the above-mentioned fingerprint padlock is as follows:

As shown in FIG. 3, when the movable end 21 of the lock rope 20 is inserted into the lock hole of the lock case 10, the movable end 21 of the lock rope 20 pushes the bolt 54, and the lock detecting unit 40 detects the locking and sends a locking signal. At the same time, due to the action of the bolt spring 55, the bolt 54 is reset, and the motor 53 drives the driving cap 56 to rotate clockwise, so that the lug boss 561 drives the tumbler spring 57 to move upward, and the tumbler spring 57 drives the tumbler 52 to move upward. When the tumbler spring 57 is moved upward to a limit position, even if the motor 53 is still rotating, since the lower terminal of the tumbler spring 57 is clamped into the vertical groove 571, the lug boss 561 slips in the gap at the bottom of the tumbler spring 57. As a result, lug boss 561 will no longer continue to drive the tumbler spring 57 to move upward, nor will it be pulled away from the gap at the bottom of the tumbler spring 57. At this time, the tumbler 52 is inserted into the limiting portion 543 of the bolt 54, the bolt 54 is limited in a space in which the bolt 54 is hard to move, and the fingerprint padlock is in a "locking state."

Figure 4:
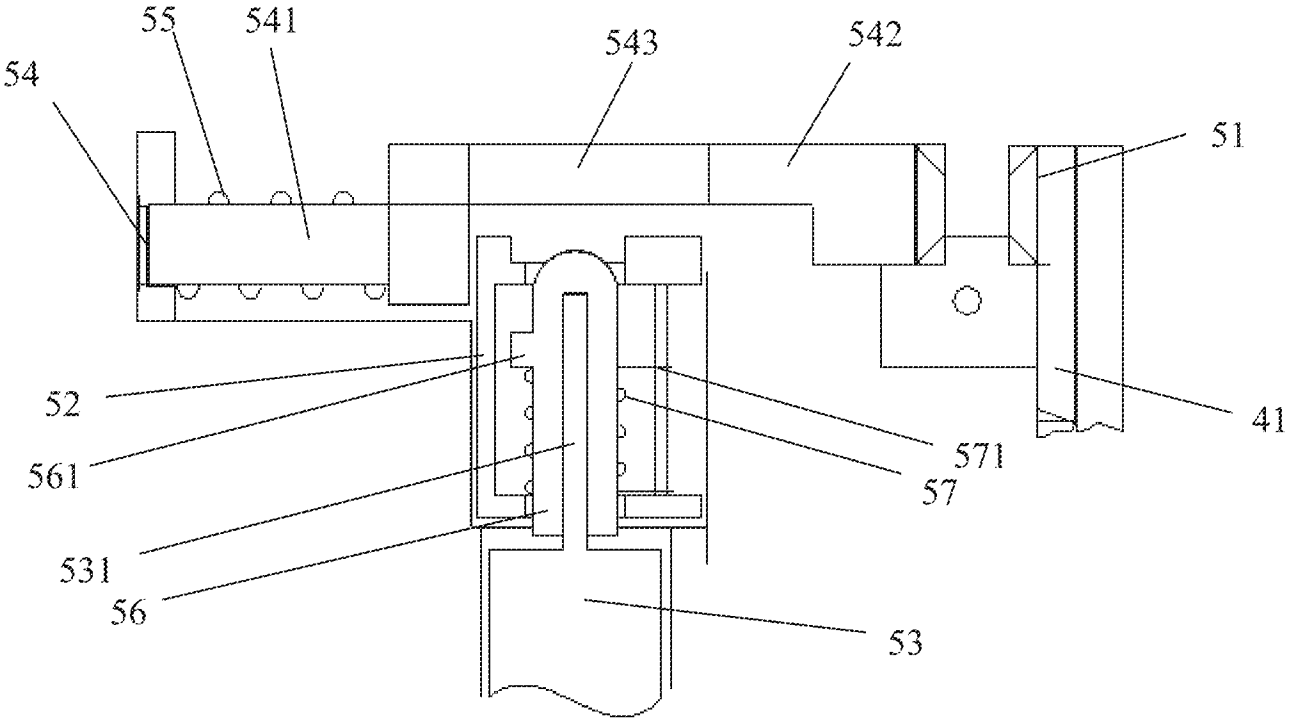
FIG. 4 is a schematic structural diagram of an exemplary fingerprint padlock when being unlocked according to an embodiment of the present invention.

As shown in FIG. 4, in a locking state, when the fingerprint unit 30 collects a correct unlocking signal, the motor 53 rotates in the reverse direction to drive the driving cap 56 to rotate in the reverse direction, so that the tumbler spring 57 drives the tumbler 52 to move downward. At this time, the bolt 54 is not limited by the tumbler 52, the movable end 21 of the lock rope 20 is pulled out forcefully, the bolt 54 is pushed, and the movable end 21 of the lock rope 20 is disengaged from the position of the bolt to realize unlocking. Similarly, when the tumbler spring 57 is moved down to the limit position, even if the motor 53 is still rotating, since the terminal at the top of the tumbler spring 57 is clamped into the vertical groove 571, the lug boss 561 slips in the gap at the top of the tumbler spring 57 and will not continue to drive the tumbler spring 57 to move downward, nor will it be pulled away from the gap at the top of the tumbler spring 57.

To sum up, the fingerprint padlock provided by the embodiments of the present invention uses the lock rope as a locking component. The length of the lock rope can be freely selected, and the lock rope has the flexible bending and curling characteristics. Therefore, the lock has great convenience and practicability, and may be even suitable for the locking requirements of different kinds of guns. In addition, due to the structure of the locking unit, when the tumbler moves to an extreme position, even if the motor is still rotating, the tumbler will not continue to move up or down, and will not press the internal structure of the padlock. Thus, the fingerprint padlock has no "dead point" and the internal structure of the padlock is not easy to be damaged.

The above description only describes preferred embodiments of the present invention, and is not intended to limit the present invention. Any modifications, equivalent substitutions and improvements made within the spirit and principles of the present invention should be included in the scope of protection of the present invention.

While the present invention has been disclosed with references to certain embodiments, numerous modification, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fingerprint padlock comprising:
- a lock case provided with a lock hole,
- a lock rope,
- a locking unit,
- a lock detecting unit, and
- a fingerprint unit;
- wherein the locking unit, the lock detecting unit, and the fingerprint unit are enclosed in the lock case;
- wherein the lock rope comprises a fixed end and a movable end, the fixed end being fixed in the lock case, and the movable end being configured for being inserted into the lock hole;
- wherein the lock detecting unit is configured to detect whether the movable end is inserted into the lock hole or not;
- wherein the fingerprint unit is configured to detect whether a fingerprint of a user is matched or not, and to send an unlocking instruction to the locking unit when the fingerprint of the user is matched;
- wherein the locking unit is configured to lock and unlock the movable end and the locking unit comprises:
  - a locking fixing member,
  - a tumbler,
  - a motor having a motor shaft,
  - a bolt comprising a guiding portion, a locking portion, and a limiting portion formed by hollowing out from the locking portion,
  - a bolt spring,
  - a driving cap having a lug boss, and
  - a tumbler spring sleeved on the driving cap;
  - the bolt spring being mounted on the guiding portion of the bolt; a gap for the movable end of the lock rope to insert being formed between the bolt and the locking fixing member; the driving cap being fixedly mounted on the motor shaft of the motor; the lug boss being able to rotate in a threaded gap of the tumbler spring to drive the tumbler spring to move when the driving cap rotates; a vertical groove being formed in the tumbler; and an upper and a lower terminals of the tumbler spring being clamped into the vertical groove and being able to slide up and down in the vertical groove.

2. The fingerprint padlock of claim 1, wherein the lock detecting unit comprises an infrared emitting tube and an infrared receiving tube, and a detection PCB sensor connected with the infrared emitting tube and the infrared receiving tube; wherein the infrared emitting tube, the infrared receiving tube, and the detection PCB sensor are relatively positioned.

3. The fingerprint padlock of claim 1, wherein the lock case comprises a surface shell and a bottom shell, the surface shell and the bottom shell being configured to interlock with each other.

4. The fingerprint padlock of claim 3, wherein the tumbler, the motor, the tumbler spring, and the driving cap are assembled into a whole and embedded in the bottom of the inside of the surface shell; when the movable end of the lock rope is inserted into the gap between the bolt and the locking fixing member, the motor being able to rotate to cause the tumbler to move radially and to be inserted into the limiting portion of the bolt, thereby securing the bolt, and at this time the movable end of the lock rope being secured by the bolt and the locking fixing member.

5. The fingerprint padlock of claim 1, wherein the movable end of the lock rope comprises a cylindrical neck and a spherical head, and a diameter of the spherical head being greater than a diameter of the cylindrical neck.

* * * * *